US005662058A

United States Patent [19]

Wang

[11] Patent Number: 5,662,058

[45] Date of Patent: Sep. 2, 1997

[54] METHOD FOR PARTITIONING A GOLF BAG

[76] Inventor: Jessie Li-Kuo Wang, 46980 Ocotillo Ct., Fremont, Calif. 94539

[21] Appl. No.: 578,198

[22] Filed: Dec. 29, 1995

[51] Int. Cl.[6] ..... D05B 97/00; A63B 55/00

[52] U.S. Cl. ..... 112/475.08; 206/315.6

[58] Field of Search ..... 112/475.08, 400, 112/440, 441; 206/315.6, 315.3, 315.8; 156/93

[56] References Cited

U.S. PATENT DOCUMENTS 1,798,638 3/1931 Stone et al. ..... 206/315.6

4,172,484 10/1979 Henning ..... 206/315.6

4,604,152 8/1986 Liukko ..... 156/93

5,573,112 11/1996 Kim ..... 206/315.6

*Primary Examiner*—Peter Nerbun

*Attorney, Agent, or Firm*—Linval B. Castle

[57] ABSTRACT

A method for partitioning a golf bag to provide fourteen separate, symmetrical club partitions includes stitching together strips of cloth starting with the center and working outward in a prescribed pattern, and finally stitching the cloth together into a tube which becomes an inner liner for attachment to a golf bag.

1 Claim, 4 Drawing Sheets

Fig. 1
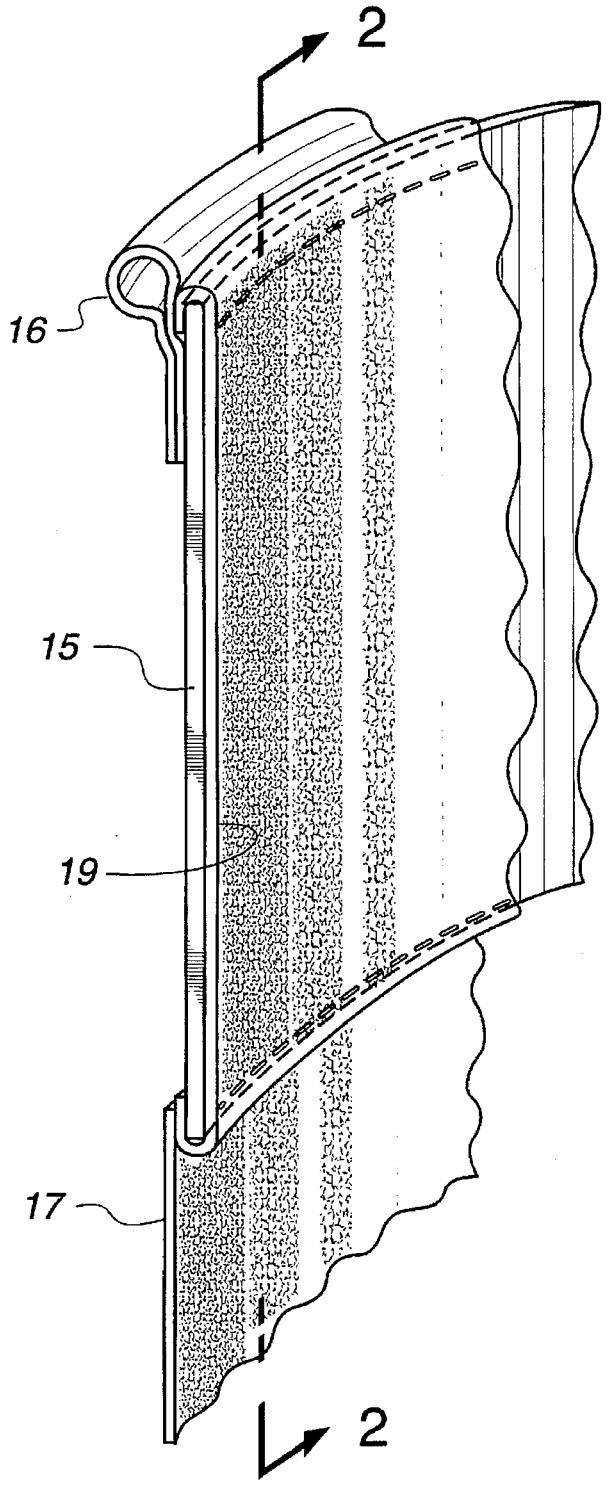
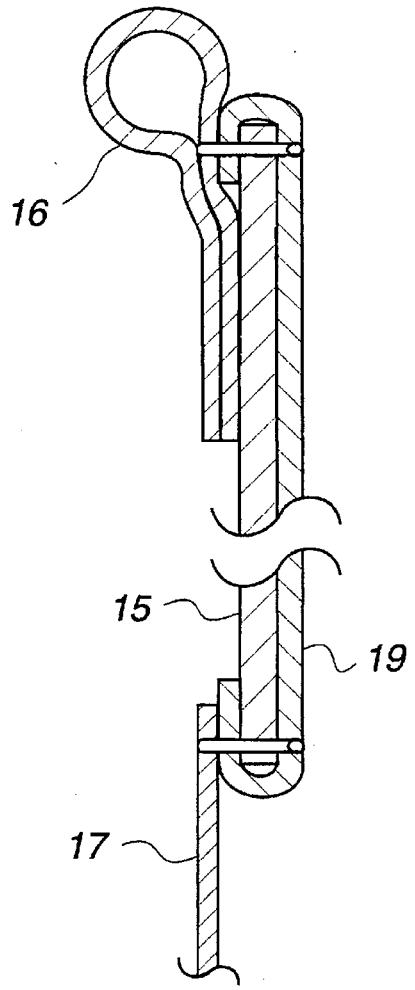
Fig. 2

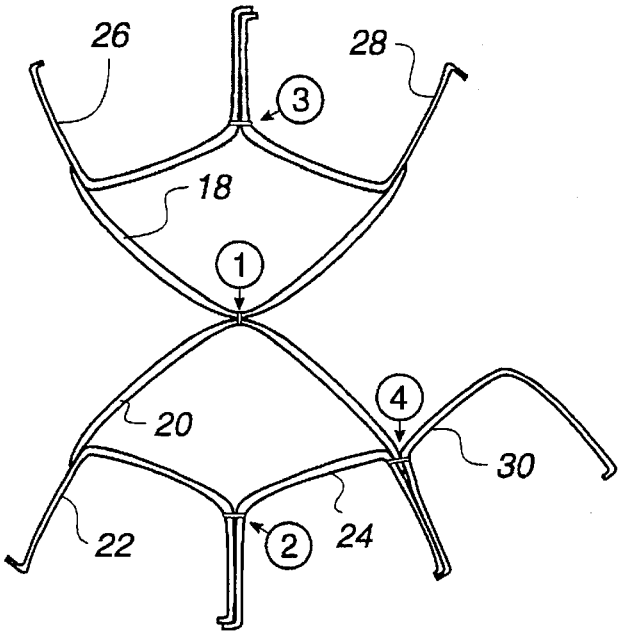
Fig. 3
Fig. 4
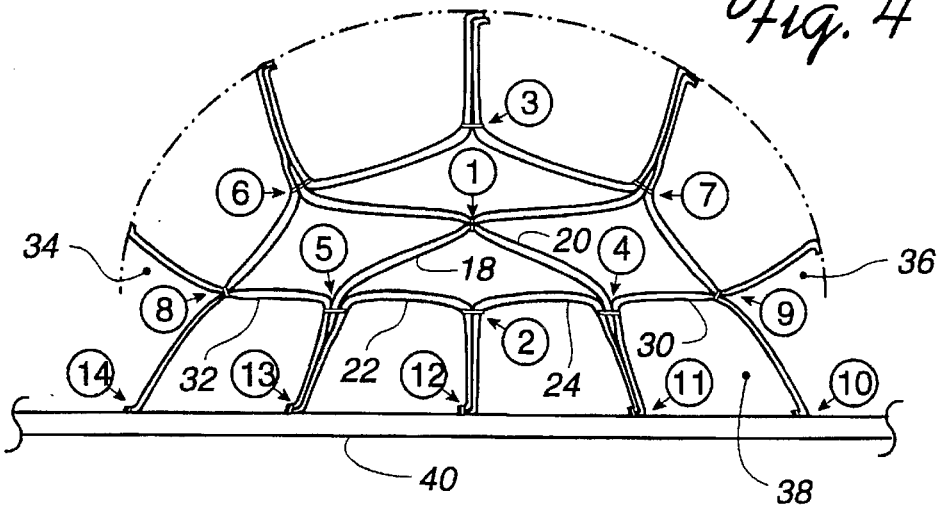
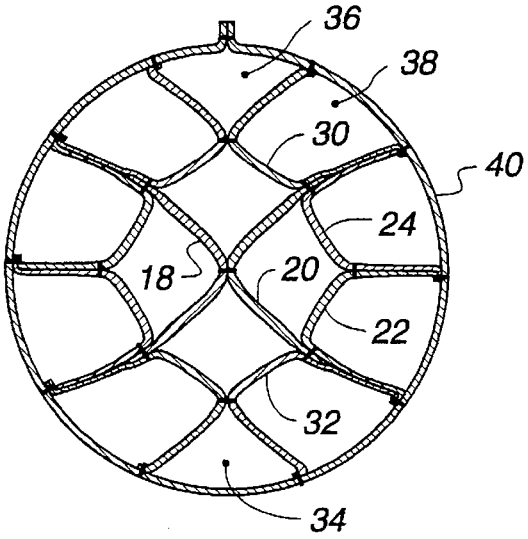
Fig. 5

METHOD FOR PARTITIONING A GOLF BAG

CROSS REFERENCE TO RELATED APPLICATIONS

This application teaches the method of fabricating the golf bag partitions illustrated in my copending design patent application Ser. No. 29/043,125, filed Aug. 25, 1995.

BRIEF SUMMARY OF THE INVENTION

This invention relates the golf club partitions in golf bags and in particular to the method of fabricating fourteen more-or-less equally sized partitions attached in a golf bag.

Golf bags are generally provided with one or two partitions comprising a strap across the opening or mouth of the bag for separating the clubs, such as separating the "woods" and "long irons" from the "short irons" and the putter. These strap partitions don't separate the clubs at the handle end, however, with the result that constant rubbing together of the leather or plastic grips damages the grips Many golfers perfer a better separation and provide individual long, light weight plastic tubes for each club. The tubes are a great advantage over the simple strap across the mouth of the bag because the long tubes isolate and protect the club handles. These tubes provide good separation of the club handles, but the club heads still gather in one side of the bag, making the shorter clubs a bit difficult to locate and causing scratching of all club heads.

I have developed partitions for a golf club bag comprising a fabric liner having fourteen individual full length pockets which are substantially equal in cross sectional area and which, together, occupy the full cross sectional area of the golf bag so that each club is adequately separated from adjacent clubs. The liner with its partitions is made and finally inserted into a bag and permanently fastened.

BRIEF DESCRIPTION OF THE DRAWINGS

In the drawings which illustrate the method of fabricating the preferred embodiment:

FIG. 1 shows a portion of the top edge of the partition liner;

FIG. 2 is taken along the line 2—2 of FIG. 1;

FIG. 3 is a plan view of the initial steps in forming the partitions, the encircled numerals indicate stitching assembly order;

FIG. 4 is a plan view of the remaining steps in forming the partitions;

FIG. 5 is a plan view of the assembled liner;

DETAILED DESCRIPTION

Figure 6:
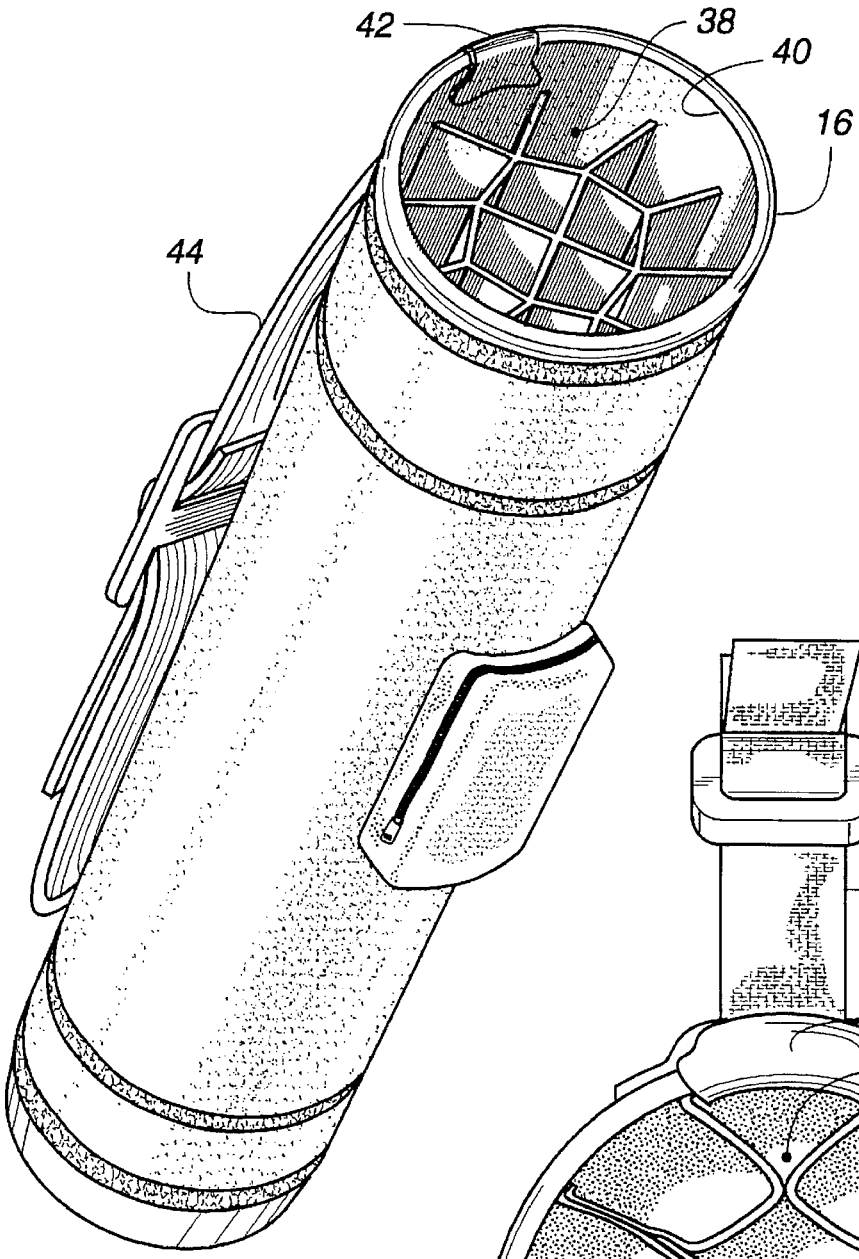
FIG. 6 is a perspective view of a completed golf bag with partitions.

The partitions for a golf bag comprise fourteen long pockets in a tubular liner that is the full length of the bag. The liner and the partitions are made of a heavy tightly woven fabric, such as dacron and are suitably trimmed to provide a pleasing appearance as well as a strong durable liner.

The tubular liner has a length that reaches the floor of the golf bag and a circumference equal to the inside circumference of the golf bag, which may have a circular cross section or be oblong or rectangular. The tubular liner initially is a rectangular sheet of the fabric about thirty inches in length and a width equal to the inside circumference of the golf bag. As shown in FIGS. 1, and 2, a thin strip of PVC 15 is sewn across the edge of the rectangular sheet 17 representing the top of the tubular liner and a fabric covered sponge sheet 19 covers the PVC 15 and provides a protection against scratching or scarring by a sharp PVC edge. Along the top surface of the PVC 15 is a resilient rubber or plastic U-shaped molding 16 which is sewn to the PVC 15 and its fabric covered sponge sheet 19 only on the inner lip, as shown. Eventually, when the tubular liner is inserted into a golf bag, the molding 16 will cover the top edge of the bag to both secure the liner and provide a bag trim.

The partitions that are within the tubular liner are made of the same material as the liner, but cut into strips. Preferably, the strips are cut from a sheet of fabric that is approximately thirty-four inches long and has about a two inch strip of fabric covered sponge sewn on each side of one end which will become the top edges of the partitions. There are two strips of four inch width and eight strips having a width of six inches. For convenience, the six inch wide strips should have temporary chalk-lines drawn longitudinally that divide the six inch width into three strips two inches in width. Also, for convenience, these chalk-lines will be referred to as "first" and "second" marks, starting from the left edge of the six inch strip.

Referring now to FIG. 3, the partitions are started from the center by first stitching together the two four inch strips 18, 20 along their longitudinal centerlines. The encircled numerals in the figure denote the order of stitching; therefore, the next steps are to stitch together the six inch wide strips 22, 24 by sewing the second mark of strip 22 to the first mark of strip 24 and by stitching the first mark of strip 26 to the second mark of strip 28. Each pair of connected strips 22,24 and 26, 28 form three sides of two partitions and appear as a letter "m".

The fourth stitching step is to stitch the edge of the four inch strip 20 between the second mark of the strip 24 and the first mark of another six inch strip 30, and the fifth step is to stitch the edge of strip 18 between the first mark of strip 22 and the second mark of another strip. This will enclose one of the four central triangular partitions and will form three sides of four rectangular partitions and partially forms half of the fourteen partitiona.

The stitching of partitions on the opposite side is continued by the sixth and seventh step, as shown in FIG. 4. The eighth and ninth steps are to stitch the first mark of the strip 32 with the corresponding strip on the opposite side and second mark of the strip 30 with the mark on its corresponding opposite strip to form two sides of two triangular partitions 34 and 36.

The partitions must now be sewn to the fabric sheet that will become the tubular liner 40. The total width of the fabric sheet must at least be equal to the inside circumference of the golf bag. Most modern golf bags are oval to rectangular in cross section and have an inside circumference of from approximately twenty-four to twenty-eight inches. The size of the golf bag will determine the spacing of the stitches along the fabric sheet 40.

It is recommended that the fabric sheet 40 be marked with longitudinal chalk-lines indicating the desired points at which the partitions are to be sewn. The sheet 40 should be marked with longitudinal chalk-lines representing the ends of the sheet to be joined into a tubular liner and with a chalk-line indicating the diameter or centerline. Then, the two equal sides of the sheet may be symmetrically chalk-lined with marks indicating the exact desired points for stitching.

The first connection of the partitions to the fabric sheet 40 is at step ten which should be made approximately two inches from the edge of the sheet 40. If the golf bag has an inside circumference of twenty-eight inches, step eleven should be to stitch the free edges of both legs of strips 24 and 30 longitudinally to the sheet 40 a distance of 2½ inches from the stitch of step ten, thereby forming an enclosed partition 38 with an irregular rectangular cross section that is approximately 2×2×2×2½ inches.

Step twelve is the stitching of the free joined legs of strips 22 and 24 to the sheet 40 a distance of 2½ inches from step eleven to form a similar rectangular partition to be followed by steps thirteen and fourteen, completing the rectangular partitiona on one half of the sheet 40 tht will become the tubular liner.

Continue with the clockwise stitching of the second half of the sheet 40 starting approximately two inches from the centerline chalk-line on the sheet, or approximately four inches from the step fourteen position, to form one triangular partition 34, four central partitions and eight rectangular side partitiona. The second triangular partition 36 is formed by the stitching together of the two side edges of the sheet 40 into its final tubular shape, as shown in FIG. 5. A disc of heavy fabric is stitched to the bottom of the partitions to keep them separated and the disc is sewn around the bottom of the tubular liner. The liner is then inserted into a golf bag.

Figure 7:
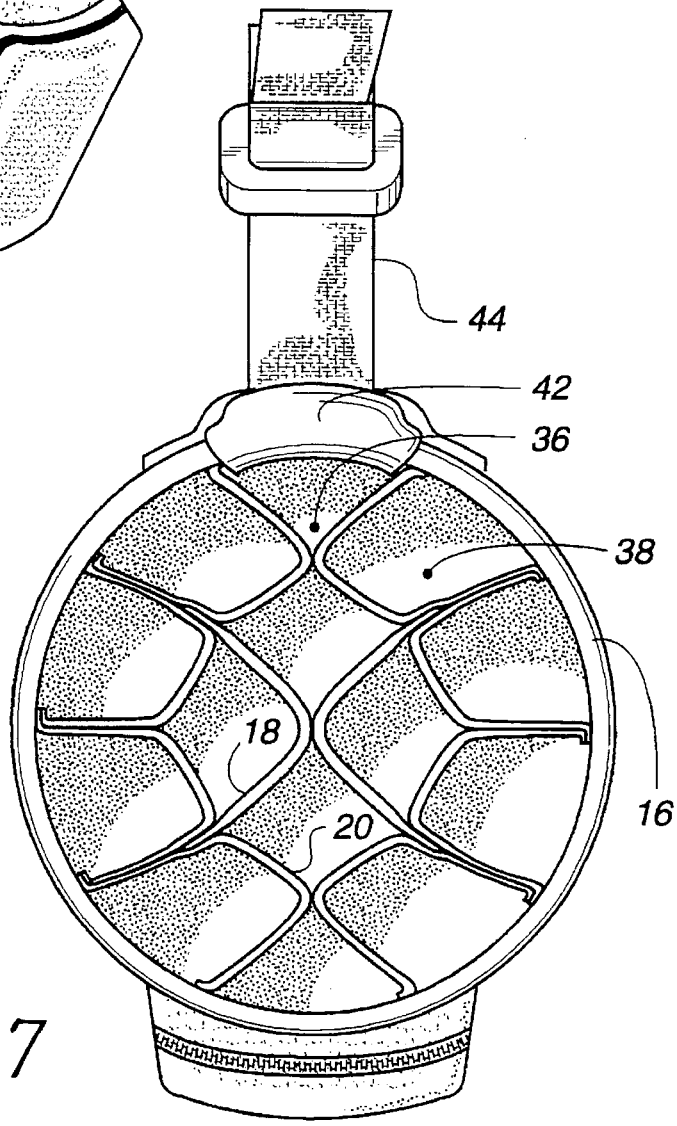
FIG. 7 is a plan view of FIG. 6.
Figures 8, 9:
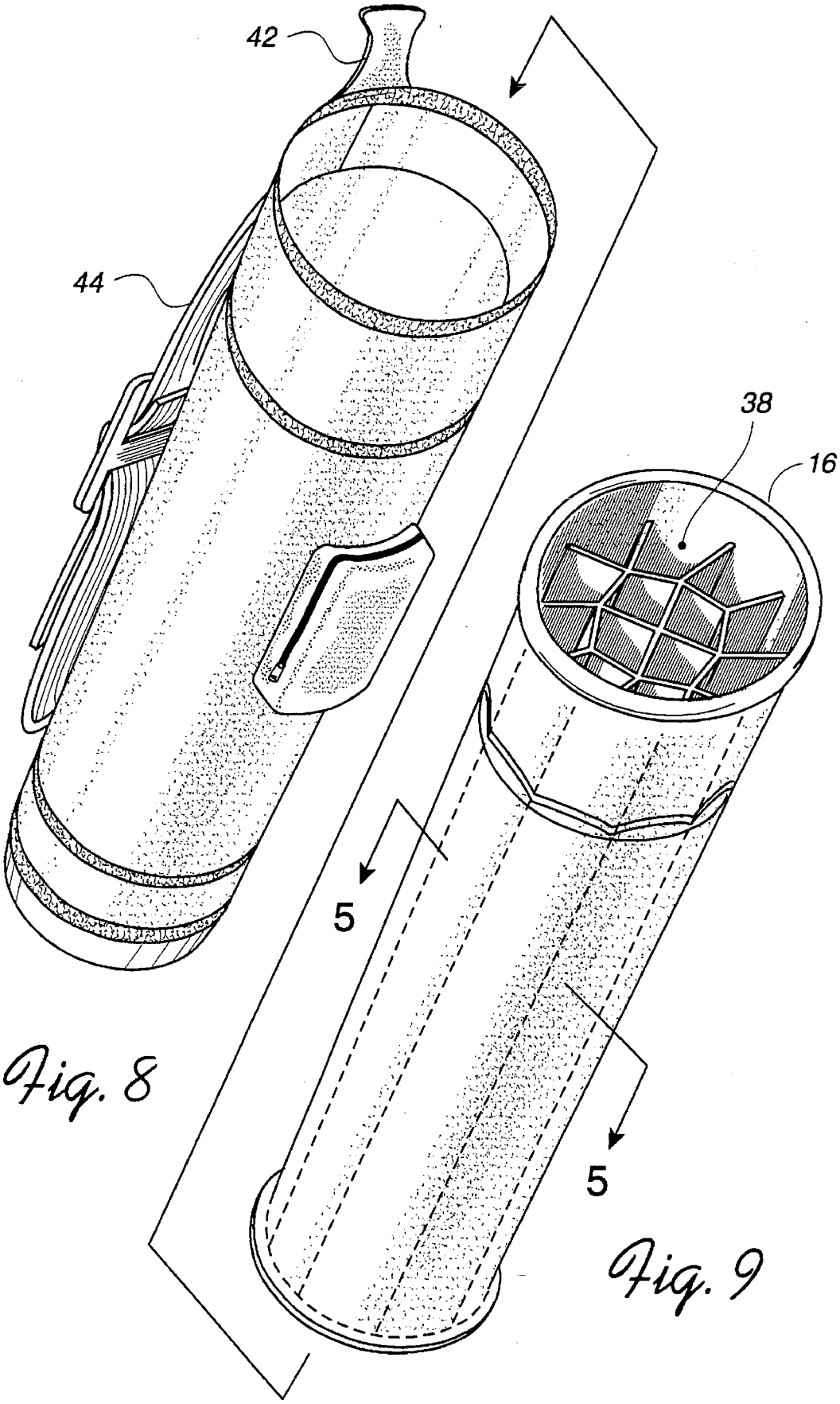
FIG. 8 is a perspective view of the golf bag ready for insertion of the liner.
FIG. 9 is a perspective view of the completed liner.

FIG. 6 is a perspective view of a typical golf bag containing the fourteen completed partitions made as described above, and FIG. 7 is a plan view of the bag of FIG. 6 showing a leather trim flap 42, which may be an extension of the bag handle or carrying strap 44 that is riveted to the exterior of, the bag as shown in FIG. 8. When the tubular liner with the partitions, shown in FIG. 9, is inserted in the bag of FIG. 8, the joining ends of the fabric covered PVC strip 15 and the tubular top molding 16 which covers the upper untrimmed edge of the bag are visible in the finished bag. Therefore, the joined ends of the PVC strip and the molding are positioned so that the leather trim 42 will cover these ends as shown in FIG. 6. The end of the leather trim is then riveted or sewn to the golf bag to secure the partitions to the bag.

I claim:

1. The method of partitioning a golf bag with full length pockets of fabric equal in length to the length of the golf bag, said pockets having substantially equal cross sections, said method comprising the steps of:

providing ten strips of partitioning fabric having the length of the pockets, two of said strips having a width of approximately four inches and eight having a width of approximately six inches, said six inch width strips having first and second marks dividing said six inch widths substantially in thirds;

stitching said four inch fabric strips together along their longitudinal center lines to form two surfaces for four central partitions, said partitions temporarily having four bare edges;

stitching together a first and second pair of the six inch fabric strips along opposite ones of said longitudinal marks;

stitching together the temporary bare edges of said four central partitions between the remaining marks on said first and second pair of strips and one of the two longitudinal marks on the four remaining fabric strips;

stitching together the four remaining adjacent six inch strips along the remaining marks;

providing a sheet of partitioning fabric having the length of said pockets and a width equal to the inside circumference of the golf bag, said sheet of fabric being divided in half along a longitudinal line and having a stiffener and trim sewn across its top edge, attaching to said sheet said first pair of six inch strips by longitudinally stitching one of the two bare edges of said six inch strips to a line approximately two inches from a side edge of a sheet of partitioning fabric and continue stitching the next four bare edges a desired spacing of approximately two and a half inches from said centerline to enclose one central and four side partitions;

starting approximately two inches after passing said line dividing said sheet in half, repeating the longitudinal stitching and two and a half inch spacing of the bare edges on said sheet to enclose three additional central, one triangular and four side partitions;

sewing together the side edges of said sheet to enclose one additional triangular partition and forming a tubular golf bag liner; and inserting said liner into the golf bag and attaching said trim to the top edge of said bag.

* * * * *